US005332370A

United States Patent [19]

Nakayama et al.

[11] Patent Number: 5,332,370

[45] Date of Patent: Jul. 26, 1994

[54] MINIATURE DIAPHRAGM PUMP

[75] Inventors: Satoshi Nakayama, Hirakata; Yoshie Watari, Nagara-Higashi; Mitsuo Nakatani, Sakai; Makoto Fujiwara, Hirakata, all of Japan

[73] Assignee: Matsushita Electric Works, Ltd., Osaka, Japan

[21] Appl. No.: 49,378

[22] Filed: Apr. 21, 1993

[30] Foreign Application Priority Data

Apr. 23, 1992 [JP] Japan ..... 4-103374
Sep. 25, 1992 [JP] Japan ..... 4-255235

[51] Int. Cl.[5] ..... F04B 43/00
[52] U.S. Cl. ..... 417/413 R; 92/98 D
[58] Field of Search ..... 417/413; 92/98 D

[56] References Cited

U.S. PATENT DOCUMENTS

| | | | |
|---|---|---|---|
| 4,232,851 | 11/1980 | Johnson | 92/98 D |
| 4,406,591 | 9/1983 | Louis | 417/413 R |
| 4,542,624 | 9/1985 | Mizusaki | 92/98 D |
| 4,801,249 | 1/1989 | Kakizawa . | |
| 4,931,000 | 6/1990 | Fleming, Jr. | 417/413 R |
| 4,987,920 | 1/1991 | Donner | 92/98 D |
| 5,074,757 | 12/1991 | Horn | 417/413 R |
| 5,074,763 | 12/1991 | Degremont | 417/413 R |
| 5,219,274 | 6/1993 | Pawlowski et al. | 417/413 R |

*Primary Examiner*—Louis J. Casaregola
*Assistant Examiner*—Michael I. Kocharov
*Attorney, Agent, or Firm*—Armstrong, Westerman, Hattori, McLeland & Naughton

[57] ABSTRACT

A miniature diaphragm pump comprises a motor having an output shaft rotating about its axis, an eccentric pin fixed in eccentric relation to the axis of the output shaft, a drive member connected to the eccentric pin to be driven thereby to reciprocate in a direction perpendicular to the axis of the output shaft, at least one pump chamber disposed radially outwardly of the drive element with respect to the axis of the output shaft and having inlet and outlet valves. Each pump chamber has one diaphragm surface with a rigid joint rod and is connected with the drive member through the joint rod. The reciprocating motion of the drive member is transmitted to each pump chamber such that one pumping action including a compression step and an inflation step is provided to the respective pump chamber during one revolution of the eccentric pin about the output shaft. In addition, since the drive member is reciprocated in the direction perpendicular to the output shaft, it is not necessary to take a large space between the motor and each pump chamber for obtaining the reciprocating motion of the drive member, so that the diaphragm pump as a whole becomes to be small.

10 Claims, 11 Drawing Sheets

MINIATURE DIAPHRAGM PUMP

BACKGROUND OF THE INVENTION

1. Field of the Invention

The present invention relates to a miniature diaphragm pump, and particularly to a miniature diaphragm pump with high pumping efficiency which is utilized for an instrument applying an air pressure, e.g., a sphygmomanometer, etc.

2. Description of the Prior Art

A miniature diaphragm pump is utilized for an instrument applying an air pressure such as a sphygmomanometer, etc. A miniature diaphragm pump of this type in the prior art is illustrated in FIG. 13, which is described in U.S. Pat. No. 4,801,249. Numeral 1E designates a miniature DC-motor, numeral 2E designates an output shaft of the DC-motor 1E, numeral 6E designates a first casing with a shape like a cup whose bottom surface is fixed to the motor 1E by screws, and numeral 30E designates a collar fixed to the output shaft 2E. Numeral 3E designates a drive shaft one end of which is fixed to the collar 30E in the state that the drive shaft 3E is inclined at a predetermined angle in respect to the axis of the output shaft 2E and the other end of which comes to a position on an extension line of the axis of the output shaft 2E. Numeral 31E designates a drive member having a disk-shaped portion 17E with three fitting holes 4E and a tubular supporting member 19E. The drive shaft 3E is slidably fitted to the tubular supporting member 19E of the drive member 31E. Numeral 7E designates a diaphragm body made of an elastic material such as soft rubber, etc. Numeral 32E designates three cup-type diaphragm portions each of which extends downwardly from the diaphragm body 7E and is formed to be integral with the diaphragm body 7E. Numeral 33E designates drive portions each of which is formed at a bottom of the respective diaphragm portion 32E. Numeral 34E designates a tubular valve body extending upwardly from the diaphragm body 7E, which is formed to be integral with the diaphragm body 7E. Each drive portion 33E is connected to the drive member 31E by pushing a head portion 39E thereof into the corresponding fitting hole 4E of the drive member 31E. Numeral 13E designates a second casing having three cylinder-like portions for fitting the diaphragm portions 32E thereto. The second casing 13E is fixed to the first casing 6E. Numeral 12E designates a cover member which is fixed to the second casing 13E through the diaphragm body 7E. Numeral 35E designates a valve casing which extends upwardly from the cover member 12E, and numeral 40E designates a common valve chamber which is formed in the valve casing 12E. Numeral 9E designates three pump chambers each of which is formed by a space surrounded with a bottom surface of the cover member 12E and the inner surface of the respective diaphragm portion 32E. Each of the pump chambers 9E is communicated with the common valve chamber 40E through the corresponding air passage groove 41E. The tubular valve body 34E is arranged in the vicinity of the air passage grooves 41E in the state that the valve body 34E is kept in close contact with the inner wall surface of the valve casing 35E to form a first check valve. Numeral 36E designates an air delivery port formed at the top of the valve casing 35E. Numeral 37E designates dish-type valve bodies made of the elastic material such as soft rubber or the like. Numeral 38E designates a plural number of air suction ports formed in the cover member 12E. The dish-type valve bodies 37E are attached to the cover member 12E in the vicinity of the air suction ports 38E in the state that each valve body 37E covers the air suction ports 38E to form a second check valve.

An operation of the miniature diaphragm pump of the prior art described above is explained below. When the motor 1E is energized and the output shaft 2E rotates, the collar 4E also rotates and the drive shaft 3E is thereby moved such that the upper end of the drive shaft BE functions as a pivot and the lower end of the drive shaft 3E performs a circular motion round the axis of the output shaft 2E. The disk-shaped portion 17E of the drive member 31E is moved upwardly and downwardly in connection with the circular motion of the drive shaft 3E, so that a cyclical volume change of each pump chamber 9E is caused by a reciprocating motion of the respective drive portion 33E in the axial direction of the motor 1E. That is, when one of the drive portions 33E is moved downwardly to increase the volume of the corresponding pump chamber 9E, an air pressure in the pump chamber 9E decreases, so that the tubular valve body 34E comes into contact with the inner wall surface of the valve casing 35E. At the same time, the corresponding dish-type valve body 37E is opened such that the air is supplied into the pump chamber 9E through the air suction ports 38E. On the other hand, when the drive portion 33E is moved upwardly to decrease the volume of the pump chamber 9E, the air pressure in the pump chamber 9E increases, so that the dish-type valve body 37E comes into contact with the cover member 12E to close the air suction ports 38E. At the same time, the tubular valve body 34E is spaced from the inner wall surface of the valve casing 35E by means of the air pressure to open the tubular valve body 34E, so that pressurized air in the pump chamber 9E is exhausted through the air passage grooves 41E to the delivery port 36E.

However, since the drive shaft 3E is connected to the collar 30E so as to incline in respect to the axis of the output shaft 2E, a considerable contact area for slidably connecting the drive shaft 3E to the tubular supporting member 19E of the drive member 31E is required for stably performing a pumping action of the miniature diaphragm pump. As a result, in this prior art, most of a space lied around the collar 30E between the disk-shaped portion 17E of the drive member 31E and the DC-motor 1E is not utilized for performing the pumping action. Therefore, it is desired to make the miniature diaphragm pump as a whole smaller by reducing the above useless space in the miniature diaphragm pump while keeping high pumping efficiency thereof.

SUMMARY OF THE INVENTION

The present invention is directed to a miniature diaphragm pump, and particularly to a miniature diaphragm pump with high pumping efficiency which is utilized for an instrument applying an air pressure, e.g., a sphygmomanometer, etc. The miniature diaphragm pump comprises a motor having an output shaft rotating about its axis, an eccentric pin fixed in eccentric relation to the axis of the output shaft, a drive member loosely connected to the eccentric pin to be driven thereby to reciprocate in a direction perpendicular to the axis of the output shaft, and at least one pump chamber disposed radially outwardly of the drive member with respect to the axis of the output shaft and having inlet and outlet valves. Each pump chamber also has one diaphragm with a rigid joint section. The diaphragm is fixed to the drive member at the joint section, so that the diaphragm is caused to curve in response to the reciprocating motion of the drive member for effecting a pumping action of alternately drawing and discharging fluid in and out of the pump chamber through the inlet and outlet valves, respectively. That is, each pump chamber provides one pumping action during one revolution of the eccentric pin about the output shaft. In addition, since the drive member is reciprocated in the direction perpendicular to the axis of the output shaft, a space between the motor and each pump chamber necessary for obtaining the reciprocating motion of the drive member is reduced, so that the pump as a whole becomes to be small.

Therefore, it is a primary object of the present invention to provide the miniature diaphragm pump mentioned above.

In a preferred embodiment of the present invention, the diaphragm of each pump chamber is molded as an integral part of an unitary pump shell. The unitary pump shell has the following structure for practical use so as to be readily formed with a considerable precision by integrally molding. That is, the pump shell comprises a rear wall member, a pair of side wall members, and the diaphragm. The diaphragm also has a thin-walled resilient portion formed around the rigid joint section. The thin-walled resilient potion comprises an upper flange having an upwardly curved cross section extending rearwardly from an upper end of the joint section, and a lower flange having an upwardly curved cross section extending forwardly from a lower end of the joint section. In this preferred embodiment, each pump chamber is formed by fitting the pump shell to a inner shell of a base plate which comprises a base wall, a rear wall, and a pair of side walls. That is to say, each pump chamber is provided with a space surrounded by the diaphragm of the pump shell and the rear, base and side walls of the inner shell. In addition, first and second sub-chambers are defined within each pump chamber on the opposite sides of the joint section. The first sub-chamber is communicated with the second sub-chamber in such a relation that one of the first and second sub-chambers is compressed when the other is expanded in response to the reciprocating motion of the drive member. Additionally, since the first sub-chamber is configured to have a larger compression and expansion volume than the second sub-chamber, each pump chamber performs one pumping action during one revolution of the eccentric pin about the output shaft.

It is also preferred that a plural number of pump chambers are located at a predetermined angle apart around the output shaft and on a substantially same circular line round the output shaft. As a result, the miniature diaphragm pump as a whole performs the pumping actions corresponding to the number of the pump chambers during one revolution of the eccentric pin about the output shaft, so that high pumping efficiency thereof is obtained.

The foregoing as well as other objects, features and advantageous of the present invention will become more apparent from the following description taken in conjunction with the following drawings.

DETAILED DESCRIPTION OF THE PREFERRED EMBODIMENTS

Figure 1:
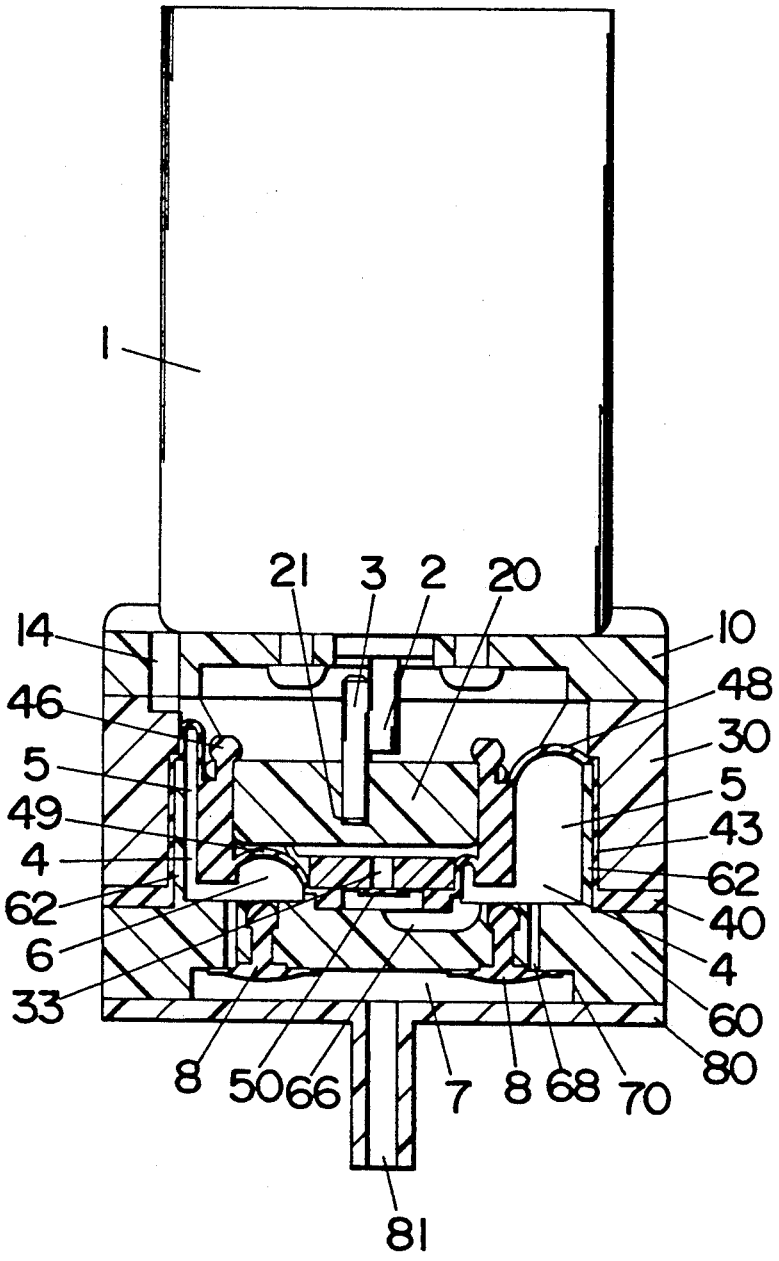
FIG. 1 is a vertical, sectional view of a miniature diaphragm pump of an embodiment of the present invention.

A miniature diaphragm pump of an embodiment of the present invention is described in detail below referring to the drawings of FIGS. 1 to 6C.

Figure 2:
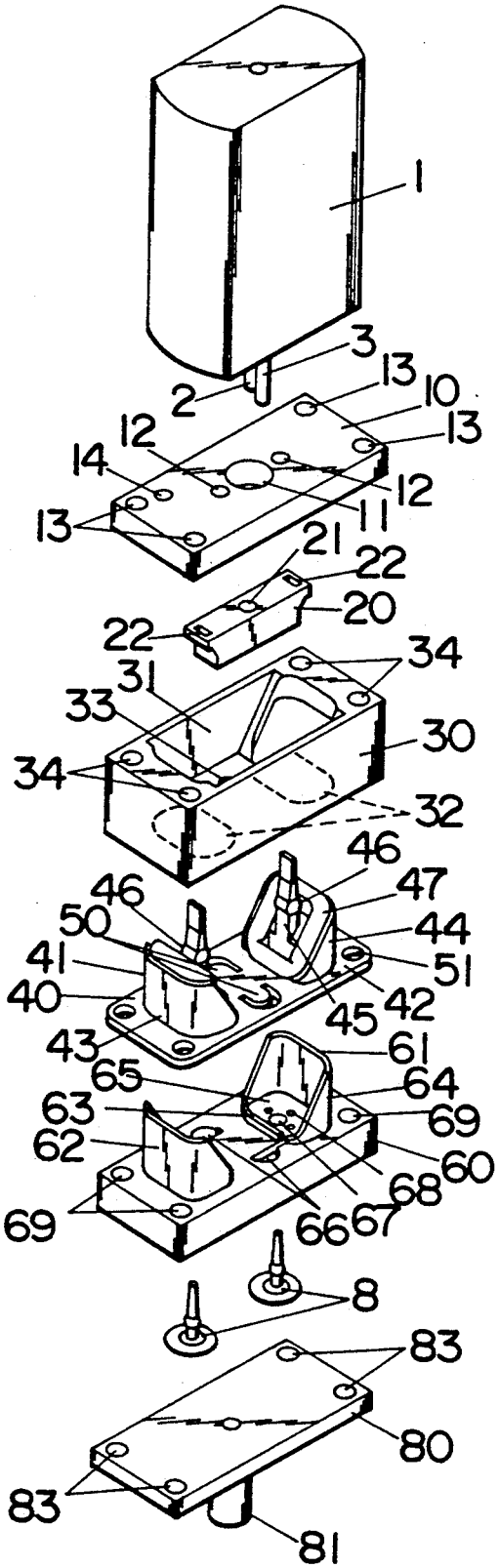
FIG. 2 is an exploded isometric view of the miniature diaphragm pump of the embodiment.

As shown in FIGS. 1 and 2, numeral 1 designates a motor having an output shaft 2 rotating about its axis, and numeral 3 designates an eccentric pin fixed in eccentric relation to the axis of the output shaft 2. Numeral 10 designates a first rectangular casing having a center through hole 11 for passing the eccentric pin 3 and the output shaft 2, an air suction port 14, two through holes 12 for passing screws used to fix the first casing 10 to the motor 1 which are arranged in the vicinity of the center through hole 11, and corner through holes 13 for passing screws (not shown) used to fix the first casing 10 to another casing described later.

Numeral 20 designates an elongated drive member which comprises a round hole 21 for loosely connecting the eccentric pin 3 with the drive member 20 and a pair of end holes 22 for connecting the drive member 20 with rigid joint rods described later. Numeral 30 designates a second casing having a first cavity 31. The second casing 30 has a pair of rounded rectangular holes 32 in the bottom surface thereof and a pair of ventilation ports 33 between the rectangular holes 32. Corner through holes 34 are formed in the second casing 30 at positions corresponding to the corner through holes 13 of the first casing 10.

Figure 6A:
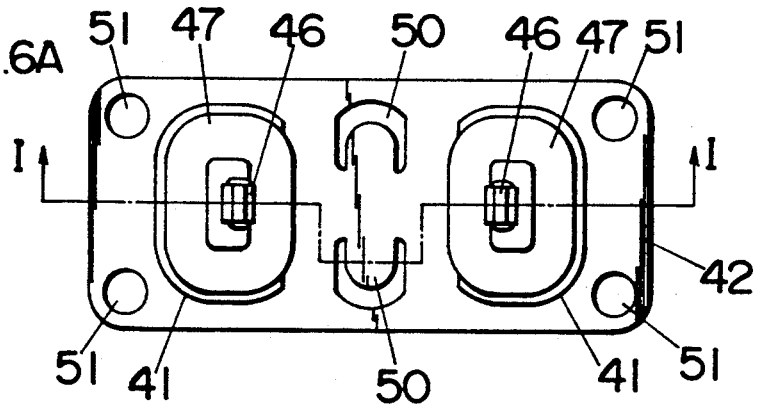
FIGS. 6A to 6C are respectively a view from above of a diaphragm unit, a sectional view on line I—I in FIG. 6A and a view from below of the diaphragm unit of the embodiment.
Figure 6B:
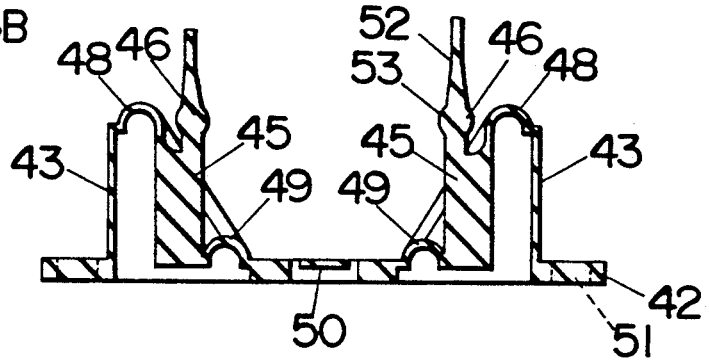
Figure 6C:
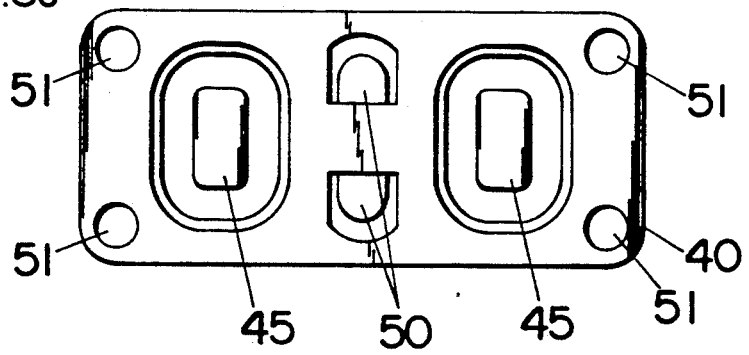

Numeral 40 designates a diaphragm unit formed by integrally molding a resilient material such as soft rubber, etc. In this embodiment, the diaphragm unit 40 comprises a pair of unitary pump shells 41 each of which has a sheet frame 42, a rear wall member 43 and a pair of side wall members 44 respectively extending upwardly from the sheet frame 42, an inclined wall member 45 extending upwardly from the sheet frame 42 to the top end of the rear wall member 43 and also a pair of non-return ventilation valves 50 arranged between the pump shells 41. Each of the inclined wall members 45 comprises the rigid joint rod 46 extending therefrom perpendicularly to the sheet frame 42 and a thin-walled resilient region 47 extending around the joint rod 46. In addition, it is preferable that the joint rod 46 extends in parallel with the rear wall member 43 over a length substantially equal to the length of the rear wall member 43. As shown in FIG. 1, the inclined wall members 45 are arranged face to face at both sides of the axis of the output shaft 2 on a substantially same circular line round the output shaft 2. In addition, the thin-walled resilient region 47 is divided by the joint rod 46 into an upper flange 48 extending rearwardly from the joint rod 46 to the upper end of the rear wall member 43 to define a first sub-chamber 5, and a lower flange 49 extending forwardly from the joint rod 46 to the sheet frame 42 to define a second sub-chamber 6. As shown in FIG. 6B, the upper flange 48 and the lower flange 49 are molded integrally with the joint rod 46 to have upwardly curved cross-sections extending rearwardly and forwardly from the joint rod 46, respectively. Additionally, the drive member 20 is connected with each of the pump shells 41 by inserting and holding the joint rod 46 of the respective pump shell 41 into the end hole 22 thereof. Generally, the joint rod 46 has a guide rod 52 and a stopper 53 useful for inserting and holding the joint rod 46 into the end hole 22. After the joint rod 46 is completely inserted to the end hole 22 such that the end hole 22 is beyond the stopper 53, as shown in FIG. 1, the guide rod 52 is separated from the stopper 53 of the joint rod 46. Corner through holes 51 are formed in the diaphragm unit 40 at positions corresponding to the corner through holes 34 of the second casing 30.

Numeral 60 designates a base plate comprising a pair of inner shells 61 each of which has a base wall 65, a rear wall 62, a front wall 63 and a pair of side walls 64 extending upwardly from the base wall 65 to define an inclined top opening extending from the upper end of the front wall 63 to the upper end of the rear wall 62, a pair of ventilation channels 66 formed in the surface thereof between the inner shells 61, a valve hole 67 formed in each base wall 65 for attaching a non-return communication valve 8 with a shape like an umbrella, and three communication ports 68 formed around each valve hole 67. When each pump shell 41 is fitted to the corresponding inner shell 61 to form a pump chamber 4, the inclined top opening of the inner shell 61 is covered with the inclined wall member 47 of the pump shell 41. Corner through holes 69 are formed in the base plate 60 at positions corresponding to the corner through holes 51 of the diaphragm unit 40.

When the second casing 30, the diaphragm unit 40 and the base plate 60 are constructed to form the miniature diaphragm pump of the present invention, each pump shell 41 of the diaphragm unit 40 is fitted to the first cavity 31 of the second casing 30 in such a manner that the rear and side wall members 43 and 44 of the pump shell 41 are respectively clamped between the rear and side walls 62 and 64 of the inner shell 61 and the corresponding walls of the first cavity 31 to hold the rear and side wall members 43 and 44 of the pump shell 41 stationary. Therefore, each pump chamber 4 is substantially provided with a space surrounded by the base, front, rear and side walls 65, 63, 62 and 64 of the inner shell 61 and the inclined wall member 45 of the pump shell 41. In each pump chamber 4, the first sub-chamber 5 is communicated with the second sub-chamber 6 through a space extending between the base wall 65 and the bottom end of the joint rod 46, as shown in FIG. 1, in such a relation that one of the first and second sub-chambers 5 and 6 is compressed when the other is expanded in response to the joint rod 46 driven by the drive member 20. In addition, the first sub-chamber 5 is configured to have a larger compression and expansion volume than the second sub-chamber 6 for performing a pumping action of the miniature diaphragm pump. Numeral 80 designates a third rectangular casing having a delivery port 81. A common valve chamber 7 is provided with a space surrounded by a second cavity 70 of the base plate 60 and the bottom surface of the third casing 80. Pressurized air supplied from each pump chamber 4 to the common valve chamber 7 is exhausted to the outside of the miniature diaphragm pump through the delivery port 81. Corner through holes 83 are formed in the third casing 80 at positions corresponding to the corner through holes 69 of the base plate 60. The first casing 10, the second casing 30, the diaphragm unit 40, the base plate 60 and the third casing 80 are integrally constructed by the screws (not shown) passed through the corner through holes 13, 34, 51, 69 and 83, respectively.

Figure 5:
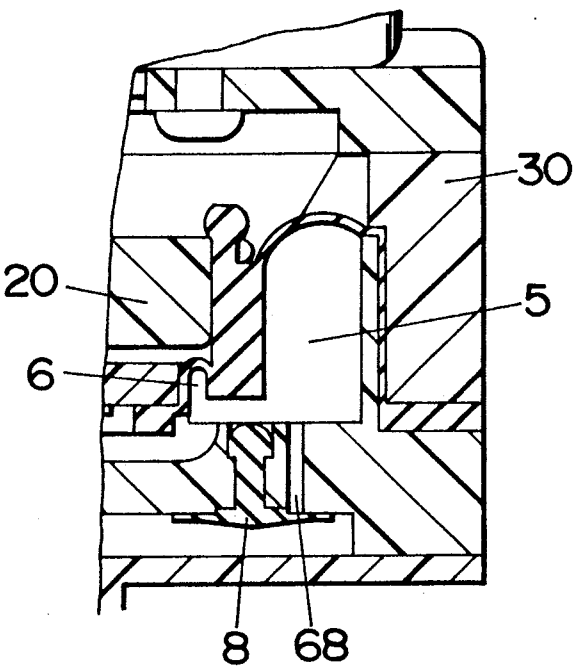
FIG. 5 is a fragmentary sectional view of the miniature diaphragm pump helpful understanding of the inflation step of the pumping action of the embodiment.
Figure 4:
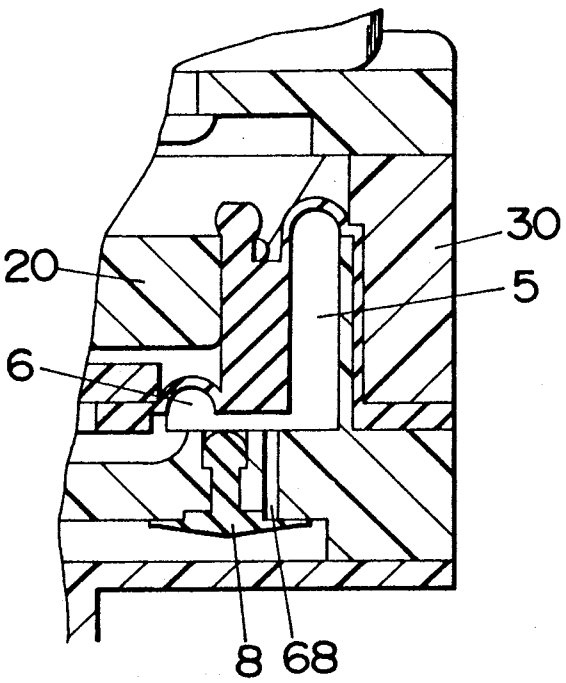
FIG. 4 is a fragmentary sectional view of the miniature diaphragm pump helpful understanding of a neutral state between the compression and inflation steps of the pumping action.
Figure 3:
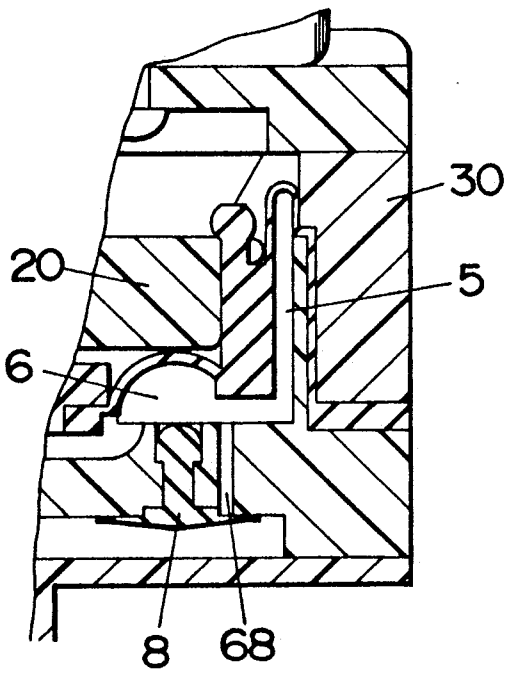
FIG. 3 is a fragmentary sectional view of the miniature diaphragm pump helpful understanding of a compression step of a pumping action thereof.

An operation of the miniature diaphragm pump described above is explained in detail hereinafter. When the motor 1 is energized to rotate the output shaft 2, the eccentric pin 3 also rotates and the drive member 20 is driven thereby to reciprocate in a direction perpendicular to the axis of the output shaft 2. Since the drive member 20 is connected through the joint rod 46 with the inclined wall member 45 of each pump chamber 4, which is an only deformable wall for effecting as a diaphragm, a volume of the respective pump chamber 4 is cyclically varied by deforming the inclined wall member 45 by the reciprocating motion of the drive member 20. Therefore, one pumping action including an inflation step and a compression step is provided to each pump chamber 4 during one cycle of the reciprocating motion of the drive member 20 During the compression step of a half cycle of the reciprocating motion, the first sub-chamber 5 of one of the pump chambers 4 is deformed to decrease a volume thereof by the joint rod 46, and the second sub-chamber 6 of the pump chamber 4 is deformed to increase a volume thereof by the joint rod 46, as shown in FIG. 3. Since a total volume of thus deformed sub-chambers 5 and 6 is decreased as compared with a total volume of the sub-chambers in a neutral state between the inflation and compression steps, as shown in FIG. 4, air in the pump chamber 4 is pressurized in the compression step. The non-return communication valve 8 corresponding to the pump chamber 4 is opened by thus pressurized air, so that the pressurized air is supplied into the common valve chamber 7 through the communication ports 68. Of course, at the same time, the non-return ventilation valve 50 corresponding to the pump chamber 4 is in a close position. On the other hand, During the inflation step of the other half cycle of the reciprocating motion, the first sub-chamber 5 is deformed to increase the volume thereof by the joint rod 46, and the second sub-chamber 6 is also deformed to decrease the volume thereof by the joint rod 46, as shown in FIG. 5. Since a total volume of thus deformed sub-chambers 5 and 6 is increased as compared with the total volume of the sub-chambers in the neutral state, the pump chamber 4 is decompressed in the inflation step, so that the ventilation valve 50 is opened to introduce air into the pump chamber 4 through the ventilation channel 66. At the same time, the communication valve 8 corresponding to the pump chamber 4 is in a close position. Since the pair of pump chambers 4 are located 180° apart around the periphery of the output shaft 2, when one of the pumping chambers 4 is in the compression step, the other one is in the inflation step. As explained above, the miniature diaphragm pump of the above embodiment performs two pumping actions during one revolution of the eccentric pin 3 about the output shaft 2.

Figure 7A:
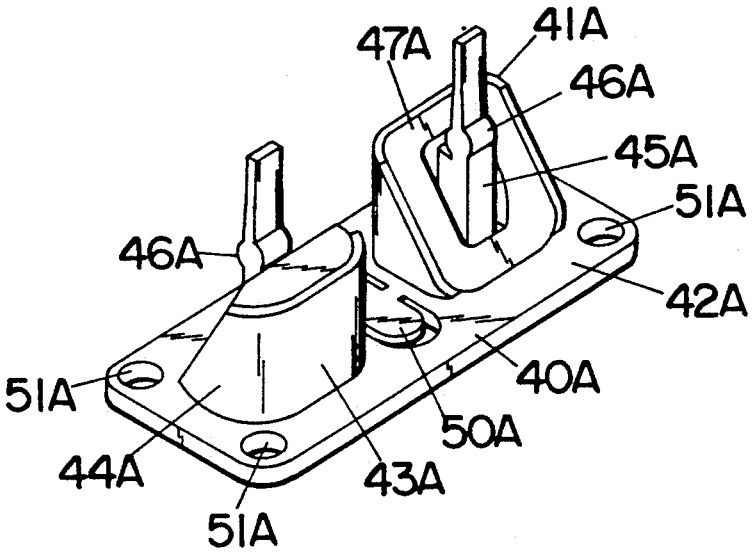
FIGS. 7A and 7B are respectively isometric views of a pump shell and a base plate of a first modification of the embodiment.
Figure 7B:
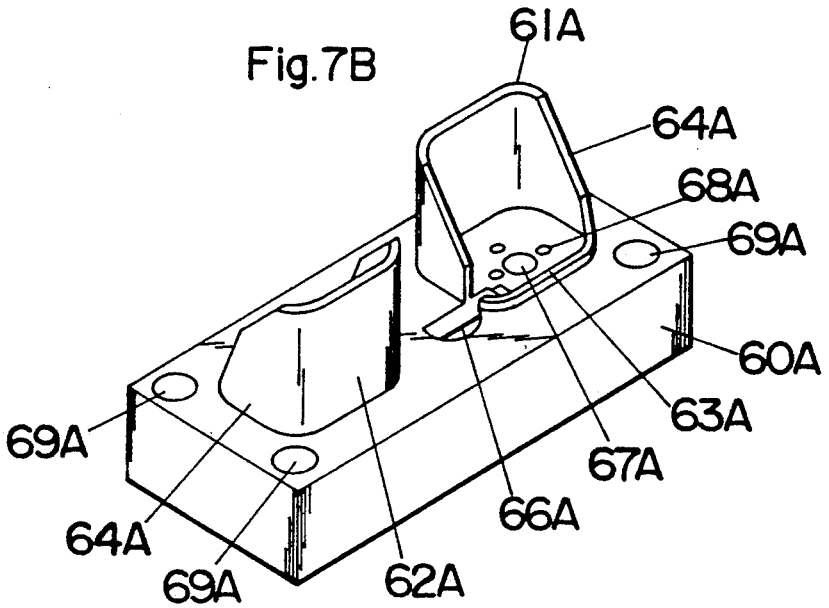

A miniature diaphragm pump of a first modification of the above embodiment is explained below referring to the drawings of FIGS. 7A and 7B. The miniature diaphragm pump is identical in structure to the above embodiment except that arrangements of pump shells 41A and inner shells 61A in the miniature diaphragm pump are different from those of the above embodiment. Therefore, no duplicate explanation to common parts and operation is deemed necessary. A modified diaphragm unit 40A of the first modification comprises a pair of longitudinally spaced pump shells 41A which are identical in structure to those of the above embodiment but are arranged to have inclined diaphragm members 45A oriented differently, i.e. in the lateral directions. A modified base plate 60A comprises a pair of inner shells 61A which are identical in structure to those of the above embodiment but are arranged in accordance with the arrangement of the pump shells 41A.

Figure 8:
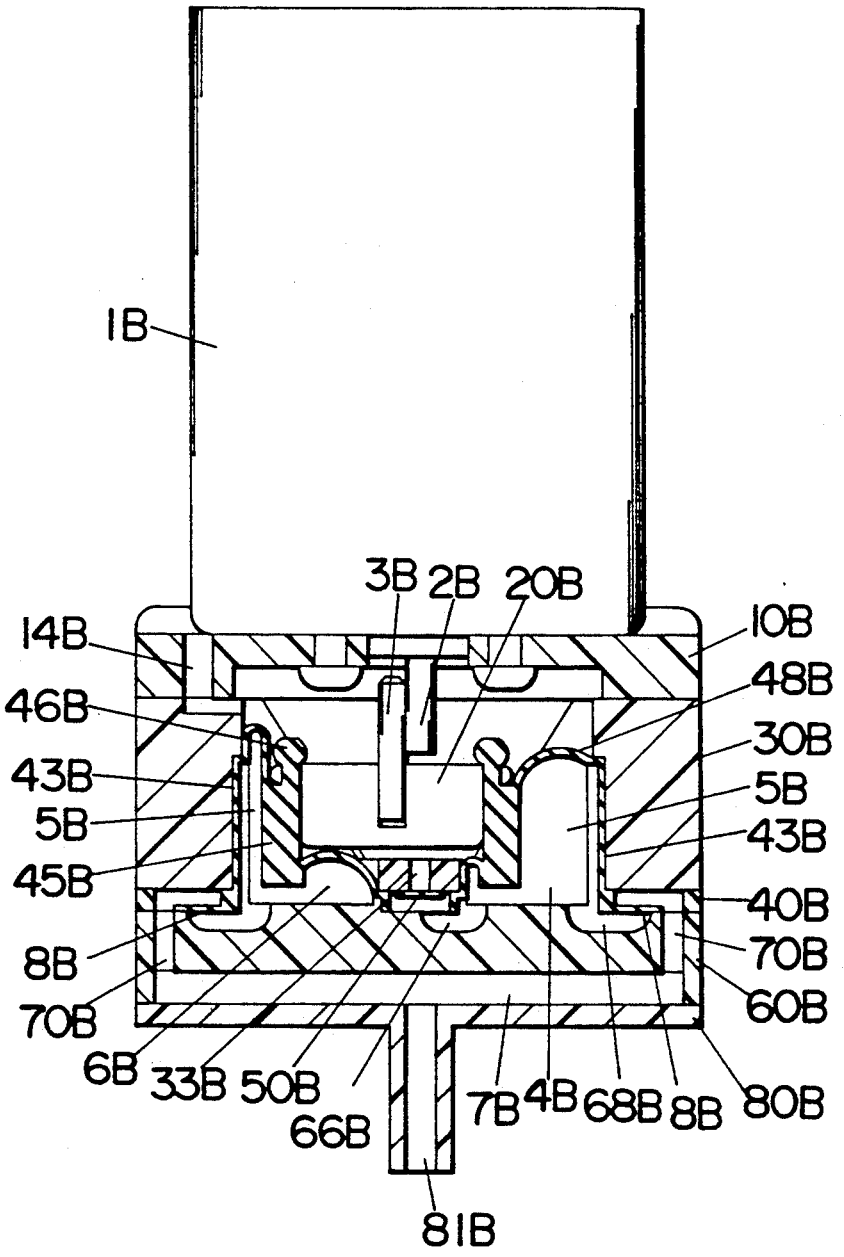
FIG. 8 is a vertical, sectional view of a miniature diaphragm pump of a second modification of the embodiment.
Figure 9A:
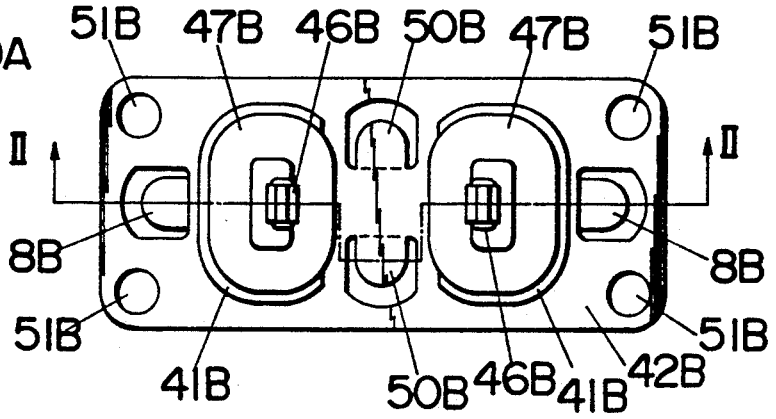
FIGS. 9A and 9C are respectively a view from above of a diaphragm unit, a sectional view on line II—II in FIG. 9A and a view from below of the diaphragm unit of the second modification.
Figure 9B:
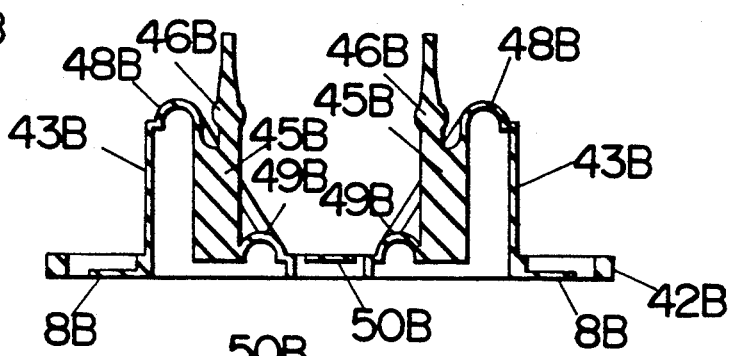
Figure 9C:
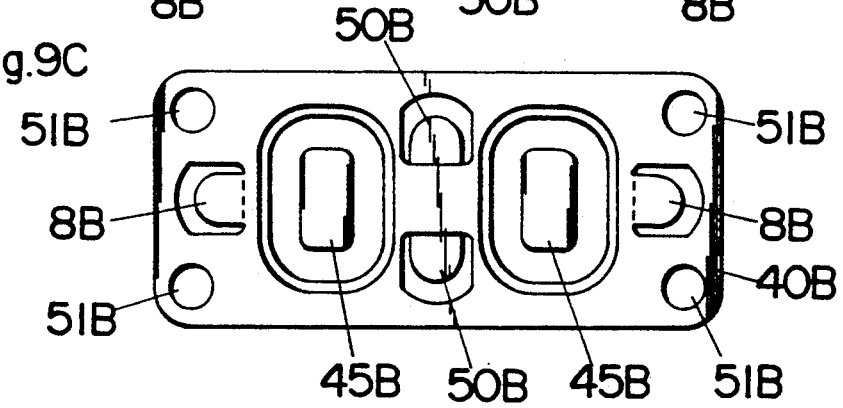
Figure 10A:
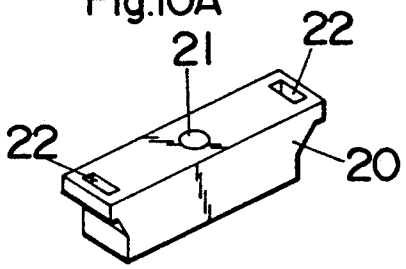
FIGS. 10A and 10C are respectively an isometric view of a drive member, a view from above of the drive member and a sectional view on line III—III in FIG. 10A of the embodiment.
Figure 10B:
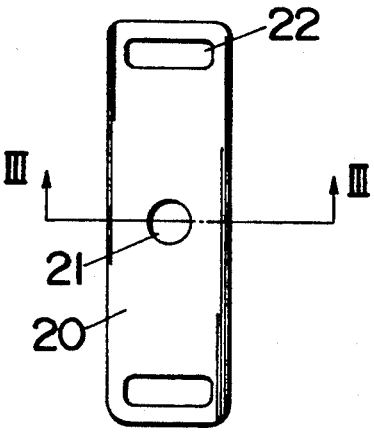
Figure 10C:
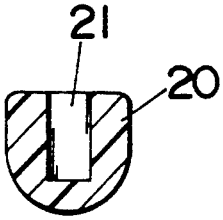

A miniature diaphragm pump of a second modification of the above embodiment is explained below referring to the drawings of FIGS. 8 to 9C. The miniature diaphragm pump is identical in structure to the above embodiment except that a diaphragm unit 40B and a base plate 60B are different from those of the above embodiment. Therefore, no duplicate explanation to common parts and operation is deemed necessary. The diaphragm unit 40B comprises a pair of pump shells 41B having the same shape as the above embodiment, a pair of non-return ventilation valves 50B and a pair of non-return communication valves 8B. In this modification, the pair of non-return communication valves 8B is molded to be integral with the diaphragm unit 40B. As shown in FIGS. 9A to 9C, each communication valve 8B is arranged adjacent to the pump shell 41B between corner through holes 51B. On the other hand, as shown in FIG. 8, the base plate 60B comprises communication channels 68B each of which extends between each pump chamber 4B and the corresponding communication valve 8B and communication holes 70B for introducing the pressurized air from the pump chambers 4B through the communication valves 8B into a common valve chamber 7B. The miniature diaphragm pump of the second modification performs substantially same pumping actions as the above embodiment.

A miniature diaphragm pump of a third modification of the above embodiment is explained below referring to the drawings of FIGS. 10A to 11C. The miniature diaphragm pump is identical in structure to the above embodiment except that a drive member 20C is different from the drive member 20 of the above embodiment. Therefore, no duplicate explanation to common parts and operation is deemed necessary. In the above embodiment, since the eccentric pin 3 is connected with the round hole 21 of the drive member 20, the reciprocating motion of the drive member 20 is obtained by revolving the eccentric pin 3 about the output shaft 2. However, only reciprocating motion in the longitudinal direction of the drive member 20 is useful for performing the pumping actions. A reciprocating motion in the transverse direction of the drive member 20 is useless for the pumping actions.

Figure 11A:
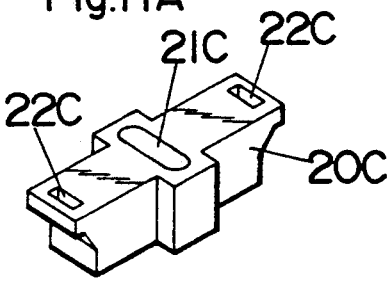
FIGS. 11A and 11C are respectively an isometric view of a drive member, a view from above of the drive member and a sectional view on line IV—IV in FIG. 11A of a third modification of the embodiment.
Figure 11B:
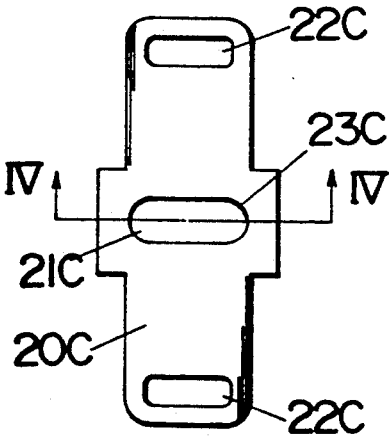
Figure 11C:
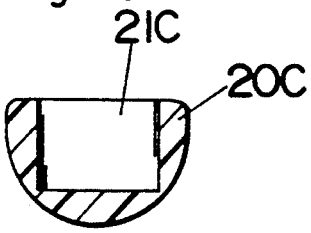

Therefore, to economize an electric power to the motor 1 used for the useless motion of the drive member 20, it is preferred that the drive member 20C with an elongated center hole 21C is used instead of the drive member 20 of the above embodiment, as shown in FIGS. 11A to 11C. The elongated center hole 21C extends in the transverse direction of the drive member 20C, and more preferably extends over a distance which is slightly smaller than a maximum diameter of an orbit in which the eccentric pin rotates. In addition, the elongated center hole 21C has a width which is slightly larger than a diameter of the eccentric pin. The elongated hole 21C also has its rounded ends 23C each of which is configured to have a radius of curvature greater than the eccentric pin. When the drive member 20C with the elongated hole 21C is used in the miniature diaphragm pump of the present invention, the eccentric pin is smoothly moved within the elongated hole 21C to give the reciprocating motion only in the longitudinal direction of the drive member 20C while keeping a contact of the eccentric pin with the inner surface of the elongate hole 21C, so that the miniature diaphragm pump is capable of performing the pumping actions without causing any noises and the useless motion of the drive member 20C.

A miniature diaphragm pump of a forth modification of the above embodiment is explained below referring to the drawings of FIGS. 12A to 12C. The miniature diaphragm pump is identical in structure to the above embodiment except that each pump shell is molded individually to obtain a pump shell unit 40D. Therefore, no duplicate explanation to common parts and operation is deemed necessary. In the above embodiment, the pair of the pump shells 41 are integrally molded to obtain the diaphragm unit 40. However, there is a problem that such a diaphragm unit 40 often creates difficulties because of a necessary complex mold with a considerable precision and its expensive cost. For example, if undesired portions with a thin thickness are formed in the upper flange 5 by the integrally molding, the flange 5 abnormally swells or bursts at the undesired portions in the inflation step of the pumping action, so that a stable pumping action may be not obtained, and also there is a possibility of causing a noise or vibration of the miniature diaphragm pump.

Figure 12A:
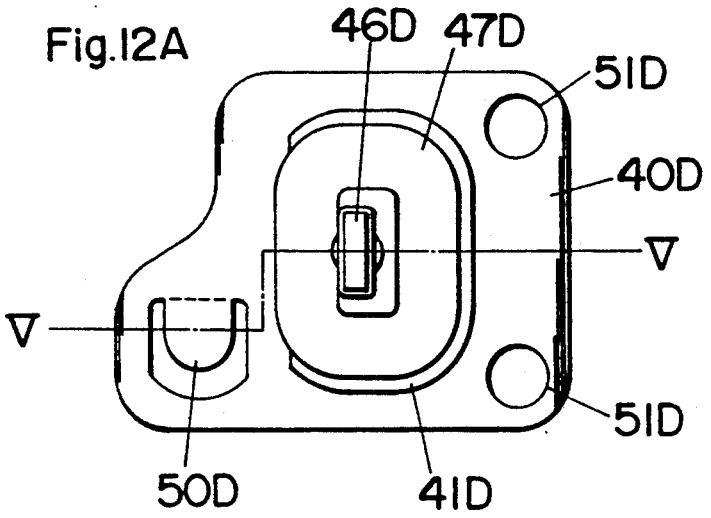
FIGS. 12A to 12C are respectively a view from above of a pump shell unit, a sectional view on line V-V in FIG. 12A and a view from below of the pump shell unit of a forth modification of the embodiment.
Figure 12B:
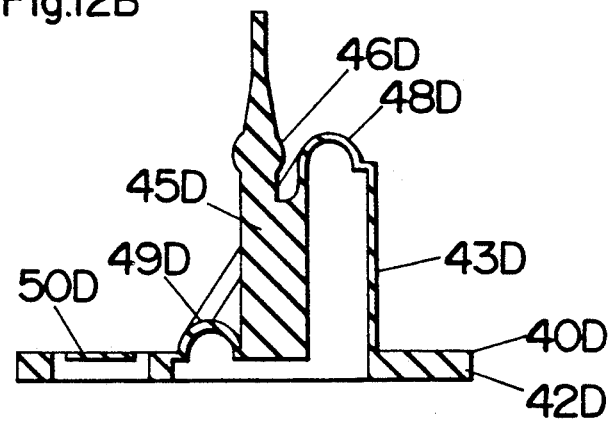
Figure 12C:
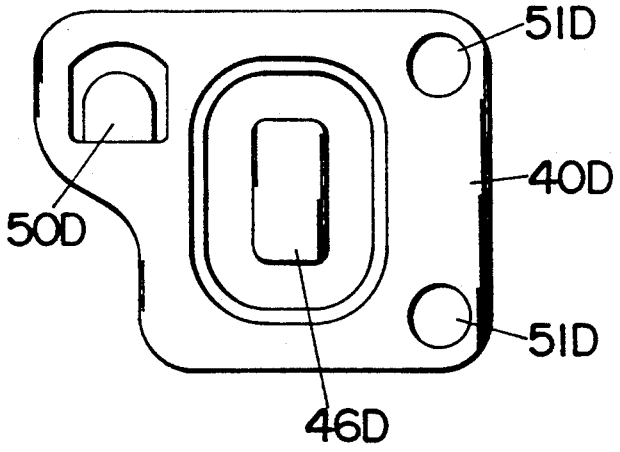
Figure 13:
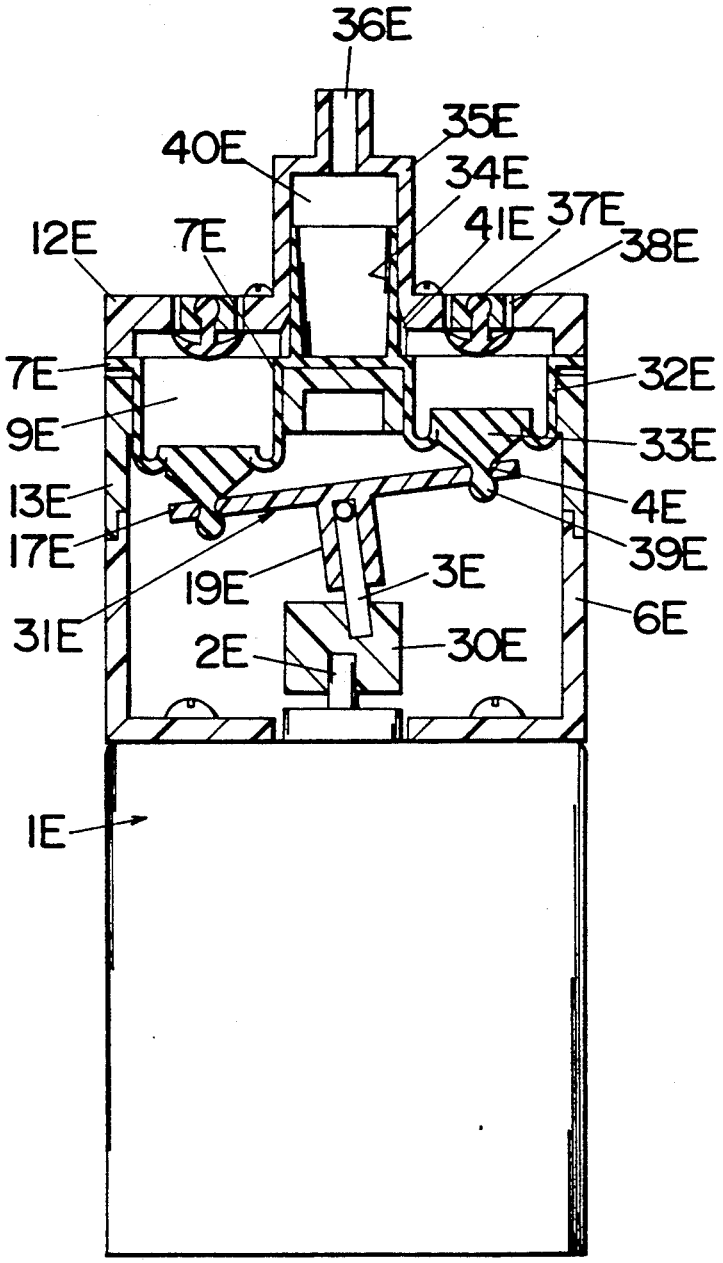
Fig.13 PRIOR ART
FIG. 13 is a vertical, sectional view of a miniature diaphragm pump of the prior art.

For preventing the above problems, it is preferred that the pump shell unit 40D is molded individually with the considerable precision, as shown in FIGS. 12A to 12C. In addition, it is preferred for improving a pumping efficiency of the miniature diaphragm pump that a plurality of pump shell units 40D are located at a predetermined angle apart around the output shaft of the motor and on a substantially same circular line round the output shaft. Additionally, it is preferred that inclined wall members 45D of the pump shell units 40D are respectively disposed in a facing relation to the output shaft for readily performing the pumping actions. For example, four pump shell units 40D are located 90° apart around the periphery of the output shaft. Of course, when the plurality of pump shell units 40D are adopted in the miniature diaphragm pump, the miniature diaphragm pump needs a drive member with end holes and a base plate with inner shells corresponding to the number of the pump shell units 40D.

Figure 14:
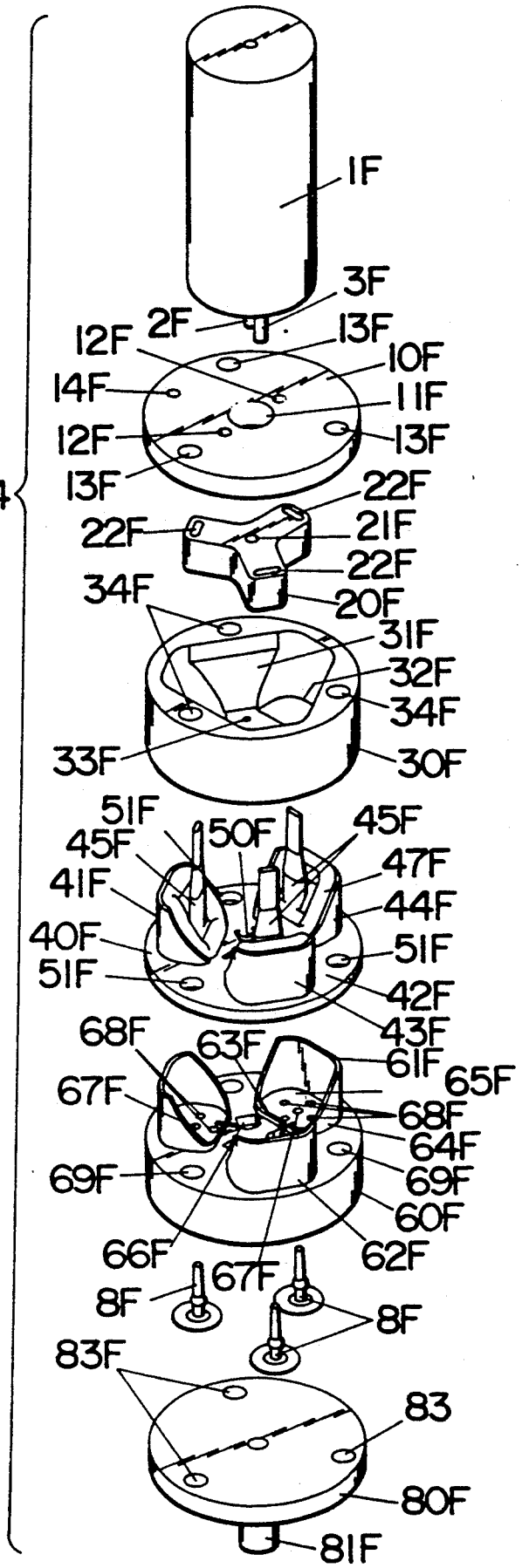
FIG. 14 is an exploded isometric view of the miniature diaphragm pump having more than two pump chambers.

FIG. 14 shows a miniature diaphragm pump having more than two pump chambers disposed radially outwardly of the drive element. This embodiment of the miniature diaphragm pump is the same as the diaphragm pump illustrated in FIG. 2 except with more than two pump chambers. Therefore, no duplicate explanation of common parts and operation is deemed necessary. In this embodiment of FIG. 14, the pump chambers are disposed radially outwardly of the drive element in a circumferentially spaced relation about the axis of the output shaft, with the pump chambers having inlet and outlet valves, respectively. Each of the pump chambers is provided with a diaphragm having a rigid joint section at which the diaphragm is coupled to the drive element so that the diaphragm is caused to curve in response to the reciprocation of the drive element for effecting a pumping action of alternately drawing and discharging fluid in and out of the pump chamber through the associated inlet and outlet valves, respectively. The pump chambers are angularly spaced about the axis of the outlet shaft with the diaphragm disposed in facing relation to the output shaft. It is preferred that the plurality of pump chambers are located apart from each other at a predetermined angle around the output shaft and on a substantially same circular line around the output shaft. As a result, the miniature diaphragm pump as a whole performs the pumping actions corresponding to the number of the pump chambers during one revolution of the eccentric pin about the output shaft, so that a high pumping efficiency is obtained.

LIST OF REFERENCE NUMERALS

1 DC-motor
2 output shaft
3 eccentric pin
4 pump chamber
5 first sub-chamber
6 second sub-chamber
7 common valve chamber
8 non-return communication valve
10 first rectangular casing
11 center through hole
12 through hole
13 corner through hole
14 air suction port
20 elongated drive member
21 round hole
22 end hole
30 second casing
31 first cavity
32 rounded rectangular hole -continued

LIST OF REFERENCE NUMERALS 33 ventilation port
34 corner through hole
40 diaphragm unit
41 unitary pump shell
42 sheet frame
43 rear wall member
44 side wall member
45 inclined wall member
46 rigid joint rod
47 thin-walled resilient region
48 first flange
49 second flange
50 non-return ventilation valve
51 corner through hole
52 guide rod
53 stopper
60 base plate
61 inner shell
62 rear wall
63 front wall
64 side wall
65 base wall
66 ventilation channel
67 valve hole
68 communication port
69 corner through hole
70 second cavity
80 third rectangular casing
81 delivery port
83 corner through hole
40A diaphragm unit
41A unitary pump shell
42A frame sheet
43A rear wall member
44A side wall member
45A inclined wall member
46A rigid joint rod
47A thin-walled resilient region
50A non-return ventilation valve
51A corner through hole
60A base plate
61A inner shell
62A rear wall
63A front wall
64A side wall
66A ventilation channel
67A valve hole
68A communication port
69A corner through hole
1B DC-motor
2B output shaft
3B eccentric pin
5B first sub-chamber
6B second sub-chamber
7B common valve chamber
8B umbrella-type non-return communication valve
10B first rectangular casing
14B air suction port
20B drive member
30B second casing
33B ventilation port
40B diaphragm unit
41B unitary pump shell
42B frame sheet
43B rear wall member
45B inclined wall member
46B rigid joint rod
47B thin-walled resilient region
48B first flange
49B second flange
50B non-return ventilation valve
51B corner through hole
60B base plate
66B ventilation channel
68B communication channel
70B communication hole
80B rectangular third casing
81B delivery port
20C drive member
21C elongated center hole
22G end hole -continued

| LIST OF REFERENCE NUMERALS | |
|---|---|
| 23C | rounded end |
| 40D | pump shell unit |
| 41D | pump shell |
| 42D | frame sheet |
| 43D | rear wall member |
| 45D | inclined wall member |
| 46D | rigid joint rod |
| 47D | thin-walled resilient region |
| 48D | first flange |
| 49D | second flange |
| 50D | non-return ventilation valve |
| 51D | corner through hole |
| 1E | miniature DC-motor |
| 2E | output shaft |
| 3E | drive shaft |
| 4E | fitting hole |
| 6E | first casing |
| 7E | diaphragm body |
| 9E | pump chamber |
| 12E | cover member |
| 13E | second casing |
| 17E | disk-shaped portion |
| 19E | tubular supporting member |
| 30E | collar |
| 31E | drive member |
| 32E | cup-type diaphragm portion |
| 33E | drive portion |
| 34E | tubular valve body |
| 35E | valve casing |
| 36E | air delivery port |
| 37E | dish-type valve body |
| 38E | air suction port |
| 39E | head portion |
| 40E | common valve chamber |
| 41E | air passage groove |

What is claimed is:

1. A miniature diaphragm pump comprising:

a motor having an output shaft rotating about its axis;

an eccentric pin connected in eccentric relation to the axis of said output shaft;

a drive element connected to said eccentric pin to be driven thereby to reciprocate in a direction perpendicular to the axis of said output shaft;

at least one pump chamber disposed radially outwardly of said drive element with respect to the axis of said output shaft and having inlet and outlet valves;

said pump chamber provided with a diaphragm having a rigid joint section at which said diaphragm having a drive element so that said diaphragm is caused to curve in response to the reciprocation of said drive element for effecting a pumping action of alternately drawing and discharging fluid in and out of said pump chamber through said associated inlet and outlet valves, respectively; and said diaphragm comprising an upper flange and a lower flange which are arranged to define within said pump chamber corresponding first and second sub-chambers on the opposite sides of said joint section, one of said first and second sub-chambers having a larger compression and expansion volume that the other one so as to be predominantly responsible for said pumping action, and is compressed when the other one is expanded.

2. A miniature diaphragm pump as set forth in claim 1, wherein said pump chamber comprises a base wall, a rear wall, and a pair of side walls extending upwardly from said base wall to define a slanted top opening extending from a front end of said base wall to an upper end of said rear wall, said diaphragm extending over said top opening to close said pump chamber, and wherein said diaphragm is formed around said rigid joint section with a thin-walled resilient portion at which said diaphragm curves to effect said pumping action as said rigid joint section is driven by said drive element to reciprocate, said thin-walled resilient portion comprising said upper flange and said lower flange, said upper flange extending from an upper end of said joint section and terminating at the upper end of said rear wall, said lower flange extending from a lower end of said joint section and terminating at the front end of said base wall, said upper flange molded integrally with said joint section to have an upwardly curved cross-section extending rearwardly from the upper end of said joint section, said lower flange molded integrally with said joint section to have an upwardly curved cross-section extending forwardly from the lower end of said rigid joint section, said first sub-chamber being configured to have a larger compression and expansion volume than said second sub-chamber so as to be predominantly responsible for said pumping action.

3. A miniature diaphragm pump as set forth in claim 2, wherein said diaphragm is molded as an integral part of a unitary pump shell which comprises a rear wall member depending from said upper flange of said diaphragm, a pair of side wall member depending from opposite sides of said thin-walled resilient portion of said diaphragm; and wherein said pump includes a base plate having said base wall and formed with an inner shell projecting into said pump shell to be cooperative therewith to define said pump chamber, said inner shell comprising said rear wall and said side walls extending from the periphery of said base wall in engagement with interior surfaces of said rear wall member and side wall members of said pump shell, said pump further including a casing having a cavity into which said pump shell is fitted in such a manner as to clamp said rear wall member and said side wall members of said pump shell between the rear wall and the side wall of said inner shell and corresponding walls of said cavity to hold said rear wall member and side wall members of said pump shell stationary while permitting only said diaphragm to deform to effect the pumping action in response to the reciprocatory movement of said drive element.

4. A miniature diaphragm pump as set forth in claim 2, wherein said joint section extends in a generally parallel relation to said rear wall over a length substantially equal to the length of said rear wall.

5. A miniature diaphragm pump as set forth in claim 3, wherein said pump shell is molded to project integrally on a frame sheet which is interposed between said base plate and said casing around said cavity, said frame sheet being formed with said inlet valve which is communicated to the exterior and interior of said pump chamber respectively through an inlet port formed in said casing and through a channel formed in the surface of said base plate.

6. A miniature diaphragm pump as set forth in claim 1, wherein said drive element is formed with a slot into which said eccentric pin extends, said slot being elongated in a direction perpendicular to the reciprocating direction of said drive element and rounded at its longitudinal ends so as to allow said eccentric pin to move within the length of said slot as said eccentric pin rotates about the axis of said output shaft of said motor, thereby avoiding undesired lateral movements of said eccentric pin from being transmitted to said drive element.

7. A miniature diaphragm pump as set forth in claim 6, wherein said slot is rounded at its longitudinal ends and extends over a distance which is slightly less than a maximum diameter of an orbit in which said eccentric pin rotates, and said rounded ends being configured to have a radius of curvature greater than that of said eccentric pin.

8. A miniature diaphragm pump as set forth in claim 1, in which an additional pump chamber of the same configuration as said pump chamber is disposed in a diametrically opposed relation to said pump chamber with respect to the axis of said output shaft and is connected to said drive element at a like joint section.

9. A miniature diaphragm pump as set forth in claim 1, wherein said at least one pump chamber is more than two pump chambers.

10. A miniature diaphragm pump as set forth in claim 9, wherein said more than two pump chambers are angularly spaced about the axis of said output shaft with said diaphragm disposed in facing relation to said output shaft.

* * * * *